US006712446B1

(12) United States Patent
Huffman

(10) Patent No.: US 6,712,446 B1
(45) Date of Patent: Mar. 30, 2004

(54) CONTROLLING PRINTING IN RESPONSE TO PRINT MEDIA CHARACTERISTICS

(75) Inventor: John W. Huffman, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 3 days.

(21) Appl. No.: 10/317,426

(22) Filed: Dec. 12, 2002

(51) Int. Cl.[7] ..... B41J 29/393
(52) U.S. Cl. ..... 347/19
(58) Field of Search ..... 347/19, 14, 10, 347/12, 11, 5, 3, 8, 23; 395/111, 109; 400/55, 56

(56) References Cited

U.S. PATENT DOCUMENTS

| | | | |
|---|---|---|---|
| 6,047,110 | A | 4/2000 | Smith |
| 6,210,052 | B1 | 4/2001 | Smith |
| 6,227,643 | B1 | 5/2001 | Purcell et al. |
| 6,291,829 | B1 | 9/2001 | Allen et al. |
| 6,325,505 | B1 | 12/2001 | Walker |
| 6,353,479 | B1 | 3/2002 | Lubawy et al. |
| 6,375,297 | B1 | 4/2002 | Hayashi et al. |
| 6,375,298 | B2 | 4/2002 | Purcell et al. |
| 6,386,671 | B1 | 5/2002 | Huston et al. |
| 6,406,199 | B1 | 6/2002 | Hayashi |
| 6,409,401 | B1 | 6/2002 | Petteruti et al. |

*Primary Examiner*—Stephen D. Meier
*Assistant Examiner*—Charles Stewart

(57) ABSTRACT

A machine readable medium in combination with at least one sheet of print media, the machine readable medium having encoded parameter information that corresponds to the sheet of print media, the machine readable medium adapted to be separable from the print media and packaging therefor such that, during operation, the machine readable medium is physically separate from the print media and packaging, for conveying the encoded parameter information to an imaging device capable of configuring at least one parameter of the imaging device based on the encoded parameter information to form an image on the sheet of print media.

11 Claims, 5 Drawing Sheets

30

CONTROLLING PRINTING IN RESPONSE TO PRINT MEDIA CHARACTERISTICS

FIELD OF THE INVENTION

The invention relates to printers generally and more particularly to controlling printing in response to characteristics of the print media.

BACKGROUND OF THE INVENTION

Notwithstanding the longstanding desire for "paperless" offices, many businesses and individuals continue to rely on hard copy for information storage and transmission, where the word "copy" may include an original document. Imaging or printing devices, engines and other print mechanisms (printing devices) are widely used in conjunction with computerized word processing, accounting, and other systems to produce original hard copy for such information storage and transmission applications. Such printing engines employ various types of printing techniques, such as ink-jets or electrophotography, and are used in devices variously known as printers, plotters, copiers, fax machines, and the like, and may print on various media, such as transparencies, foil and/or common paper, any of which media may have widely varying physical and electrophotographic attributes or characteristics (characteristics). Physical characteristics of media include sheet size, weight or thickness, and surface roughness, and other characteristics relevant to printing include brightness and transparency/opacity.

Modern printing engines can produce high-quality print results, and these results can be maintained over a wide variety of media, such as foil, plastic transparencies, and plain paper having matte, gloss, or semigloss characteristics, and for various media sizes, weights, and surface roughness. In order to provide optimum printing results over a wide range of media with varying characteristics, many types of print engine adjustments can be made. For example, U.S. Pat. No. 6,291,829, issued Sep. 18, 2001 in the name of Allen et al. describes changing or adjusting the characteristics of the printer rendering and recording process in response to different characteristics of the print media. For rendering, Allen et al. refer to selection of tone reproduction curves, halftone and error-diffusion algorithms, color maps and gamut adjustments. For recording in an ink-jet printer context, selection of ink drop volume, number of ink drops per pixel, number of passes of the printhead over the pixel, and the order and pattern in which the drops are printed in a pixel or pixel region can be selectively adjusted. Allen et al. identify the media by using optical illumination and sensors for distinguishing among different kinds of plain papers, coated papers, photographic papers, and transparency films.

Alternative schemes for providing and identifying media characteristics to print engines for controlling printing are desired.

SUMMARY OF THE INVENTION

According to one aspect of the invention, a package of print media comprises at least one sheet of print media for imaging thereon enclosed within a protective packaging. A machine readable medium accompanies the print media and packaging and includes machine readable characteristics of the print media. The machine readable medium is separable from both the print media and packaging.

According to another aspect of the invention, a printing apparatus for printing on print media, where at least one characteristic of the print media is specified on a machine readable medium which accompanies the print media, but which is separable from both the print media and packaging therefor for reading of the readable medium. The printing apparatus comprises a reader for reading the readable medium, for generating a signal representing the at least one characteristic of the print media, and a controller responsive to the signal, for configuring the printing apparatus based on the at least one characteristic to form an image on the print media.

Yet another aspect of the invention comprises a machine readable medium in combination with at least one sheet of print media, the machine readable medium having encoded parameter information that corresponds to the sheet of print media, the machine readable medium adapted to be separable from the print media and packaging therefor such that, during operation, the machine readable medium is physically separate from the print media and packaging, for conveying the encoded parameter information to an imaging device capable of configuring at least one parameter of the imaging device based on the encoded parameter information to form an image on the sheet of print media.

DESCRIPTION OF THE INVENTION

Figure 1:
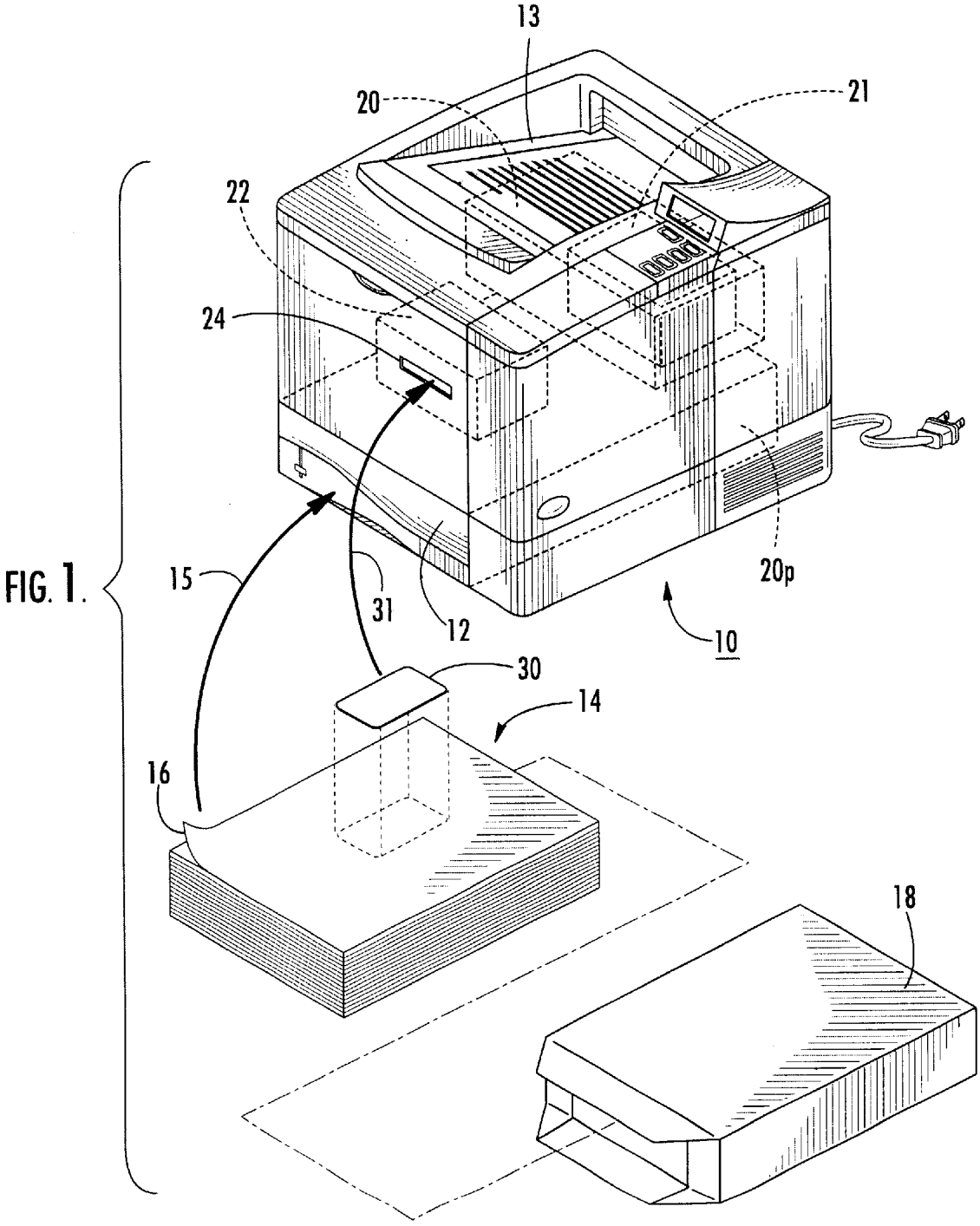
FIG. 1 is a simplified perspective view of a printing apparatus according to an aspect of the invention, together with sheets of print media and an information-bearing medium.

FIG. 1 is a perspective view of an exemplary imaging or printing apparatus 10 according to an aspect of the invention. In FIG. 1, printing apparatus 10 includes a print media drawer or tray 12 which can be loaded with stacks 14 of print media, such as stacks of individual sheets 16 of ordinary paper, as may commonly be purchased in ream sizes, contained within a protective package envelope, illustrated as a paper envelope 18 in FIG. 1. The loading of the stack 14 into tray 12 is represented by arrow 15. While the print media has been described as ordinary paper, it may be any type of print media, such as transparencies, glossy photographic-type paper, foil, or any other media on which printing may be performed. Printing apparatus 10 may be an ordinary printer (e.g. laser printer, ink jet printer, dry medium printer, etc.) for connection to a computer or network, or it may be a stand-alone device such as a facsimile (fax) machine, copier, plotter, or multifunction apparatus, each of which uses a print engine or device, illustrated in phantom as 20, to perform the actual printing task associated with the function(s). Print engine or device 20 includes paper tray 12 and a paper-handling path 20*p* for moving paper through the print engine or device 20 to an output tray 13. Print engine 20 also includes one or more control arrangements, illustrated as 21, for configuring the imaging device by adjusting or controlling parameters of print engine 20 in response to signals representing one or more characteristics of the print media.

As shown in FIG. 1, the print media package or assembly according to an aspect of the present invention comprises one or more sheets 16 of print media of given type enclosed within protective packaging illustrated as packaging envelope 18. Machine readable medium or record 30 accompanies the print media and packaging and contains encoded parameter data corresponding to characteristics associated with the sheets of print media within the packaging envelope. While record 30 accompanies the print media and packaging, the record is separable from both the print media and packaging therefor such that, during operation, the record is physically separate from the print media and packaging. Record 30 is operable for conveying the encoded parameter data to printing apparatus 10 for configuring the printing apparatus based on the encoded parameter data to form images on the sheets of print media.

In an exemplary embodiment, record 30 comprises a smart card or other machine readable medium (including, e.g. an electronically or optically readable medium) which, during transport of the media assembly, is disposed between the print media and the inner surface of envelope 18. The machine readable record is adapted to be read by a corresponding record reader. The record and reader can be any electronic, optical, magnetic or other suitable conventional record/reader system operative to convey/receive information from the record corresponding to characteristics of the accompanying print media. Examples include bar code scanners, magnetic strip readers, RFID tags and the like.

Record 30 may be held within the package (prior to opening of the package) by the tensile force of the packaging 18 against the sheets 16 of print media. Alternatively, record 30 may be detachably coupled to either the interior of the packaging envelope (e.g. via an adhesive) or to one of the sheets of material, or to both, during transport, or upon opening of the package. Record 30 may also be inserted within a sleeve, holder, or other carrier associated with the packaging or media and removable therefrom when the package assembly is opened. It is, of course, also contemplated that record 30 may be detachably coupled to the exterior surface of the packaging. Record 30 is thus adapted to be stored with or accompany the print media within the media packaging, but separable from both so as to be used, during operation, at a location physically remote from the print media 16 and the packaging 18.

Printing apparatus 10 of FIG. 1 is provided with a reading device (reader) illustrated in phantom as block 22, which has a slot or holder 24 defining a location at which reader 22 can read record 30. Reader 22 and holder 24 are selected to accommodate and read machine readable record 30 which accompanies the individual sheets 16 but is physically separated from both the stack 14 and from the packaging 18. Arrow 31 illustrates the application of record 30 to the location established or specified by holder 24 of reader 22.

Record 30 stores information relating to at least one characteristic of the sheets, so that when record 30 is placed in the location specified by holder 24, reader 22 can read the information relating to that characteristic. Reader 22 then makes the information relating to the characteristic(s) of the media available to the control arrangement 21 of print engine 20 for configuring the printer based on those characteristic(s) to form an image on the print media. Among the possible media characteristics which may be stored on record 30 and made available to print engine 20 are media type (e.g. paper, plastic, coated, etc.) size, weight, thickness, media form (e.g. labels, checks, envelopes, etc.), transparency, opacity, surface roughness, speed at which media can be fed into a device, quantity, length and the like. Possible control or adjustments which might be made in response to such information might include adjustment of various printer parameters applicable to the type of printing being performed, including, but not limited to, dimensions of the paper tray 12 and/or paper path 20*p*, toner fusing temperature and/or time in the case of electrophotographic printing, and ink jet drop timing, density and/or distribution in the case of inkjet printing. Control arrangement or controller 21 typically includes memory, so that the information relating to the characteristic(s) of the print media which is read from the record 30 may be stored for use during that interval during which the sheets 16 are being printed to. Such memory includes EEPROM, flash memory and/or read only memory (ROM), random access memory (RAM) and hard disk and associated drive circuitry.

Record 30 of FIG. 1 may further be a paper or cardboard card, to or on which optically readable contrasting markings have been applied. Such markings as bar codes and circle codes can be used. The optically readable markings can be placed on both sides of the card, if desired, so that the reader 22 can read the card regardless of the orientation with which it is inserted into the holder or slot 24. The card may also, additionally bear human-readable markings. For reading an optically-readable record, the record reader 22 of FIG. 1 includes an optical reader for reading the record when the record is placed in the appropriate location, as established by the holder 24.

A salient advantage of the above, compared with the marking of each page of the print media, is that only the record needs to be marked with information relating to the characteristics of the print media. Thus, for a 500-page ream of media, for example, only one print operation need be performed for the record, rather than 500 print operations, one for each sheet. In addition, there is no need to take efforts to conceal the print media characteristic markings, since the card 30 of FIG. 1 is not part of the print media, and is therefore not printed on.

Figure 2A:
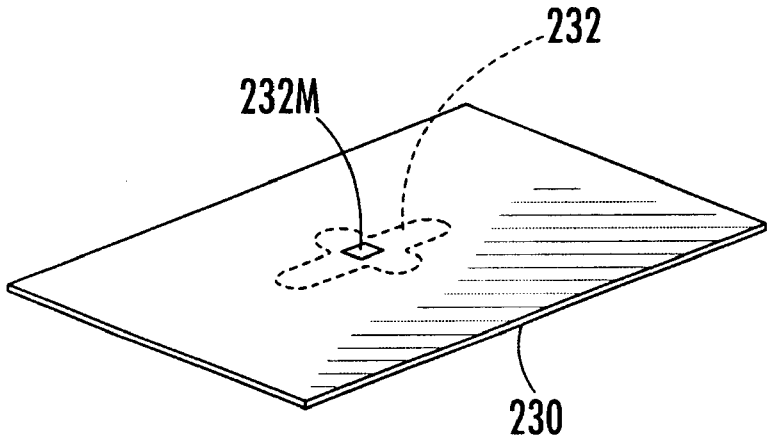
FIG. 2*a* is a simplified perspective view of one possible embodiment of the information-bearing medium of FIG. 1.
Figure 2B:
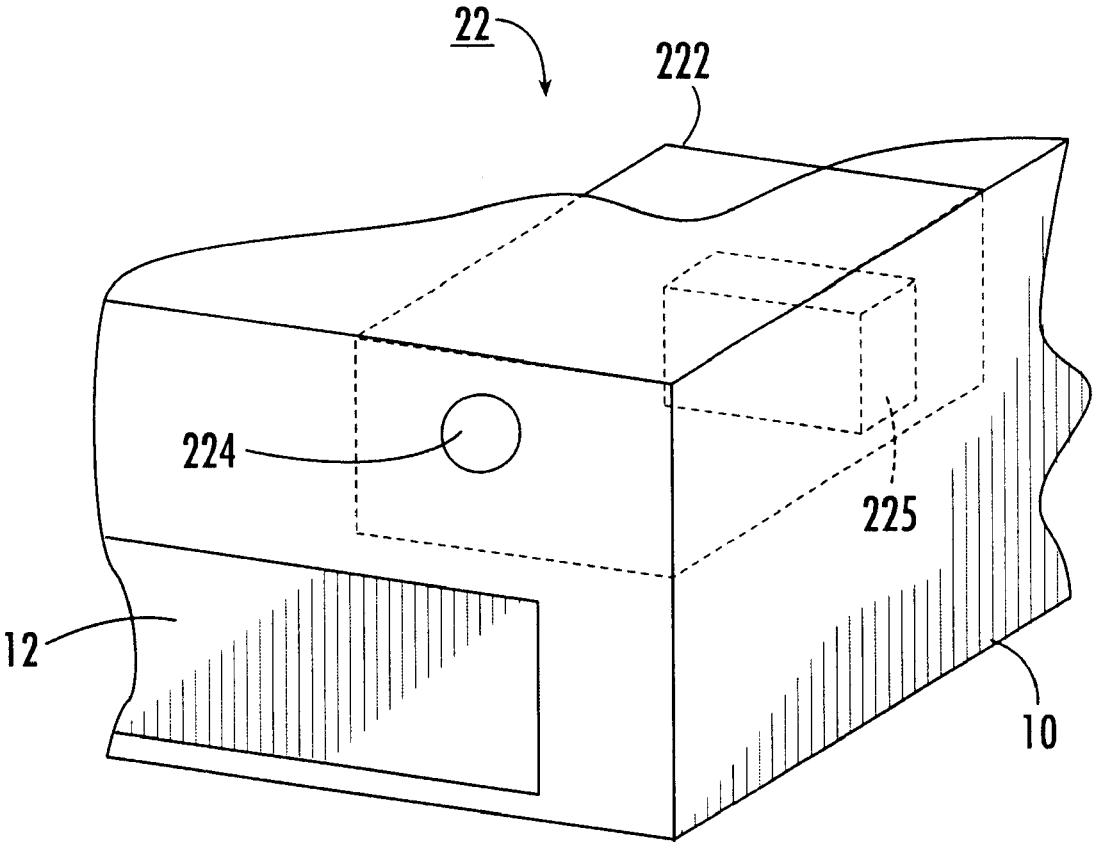
FIG. 2*b* is a simplified view of a portion of an alternative embodiment of the assemblage shown in FIG. 1.

In FIG. 2*a*, there is shown an exemplary embodiment of record 30 in the form of a "smart" card 230 onto (or into) which a radio frequency identifier (RFID) device 232 is applied. The RFID device may be pre-programmed with information specifying at least one characteristic of the associated print media. Reader 22 of FIG. 1 includes some means for creating or receiving a radio-frequency electric or magnetic field, for addressing the smart card. The smart card includes a modulator 232M, for modulating the electromagnetic field with the recorded information and the card reader 222 of FIG. 2*b* includes a sensor 224 and oscillator 225. In operation, the smart card 230 of FIG. 2*a*, when separated from the accompanying media, is passed or placed before sensor 224 to communicate the record information to reader 222. The information, once communicated, is acted upon in the same manner as that described in conjunction with FIG. 1 to configure the printing apparatus based on the record information.

Figure 6:
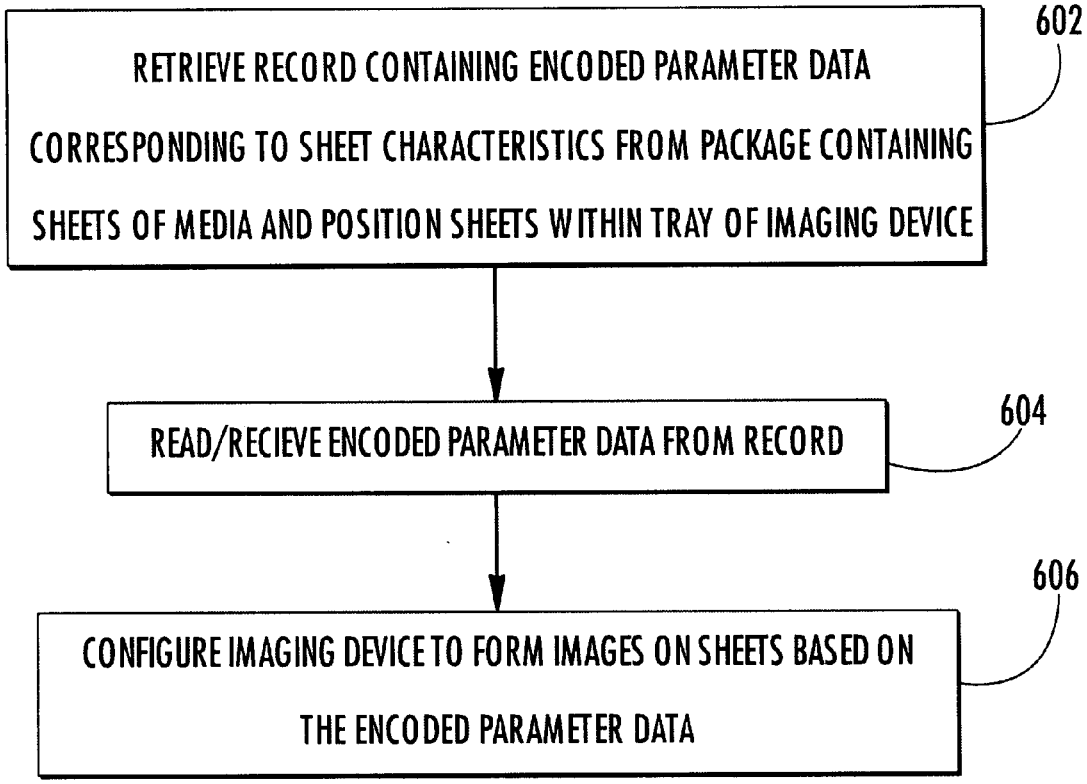
FIG. 6 is an exemplary procedure for configuring imaging device operation according to an aspect of the present invention.

FIG. 6 is a flowchart that shows an exemplary procedure 600 for configuring imaging device operation based on reading a machine readable medium accompanying sheets of print media and associated packaging but separate therefrom. At block 602, a media package assembly contains sheets (16) of print media along with a machine readable medium (30) enclosed within a protective packaging (18). The protective packaging is opened and the readable medium (30) is removed from the package. The sheets (16) of print media are positioned within a tray of an imaging device. The readable medium contains encoded parameter data corresponding to characteristics associated with the sheets. At block 604, the imaging device receives the encoded parameter data from the readable medium. At block 606, the imaging device uses the received information to configure image-forming operations to form images on the sheets of the print media within the tray.

Figure 3:
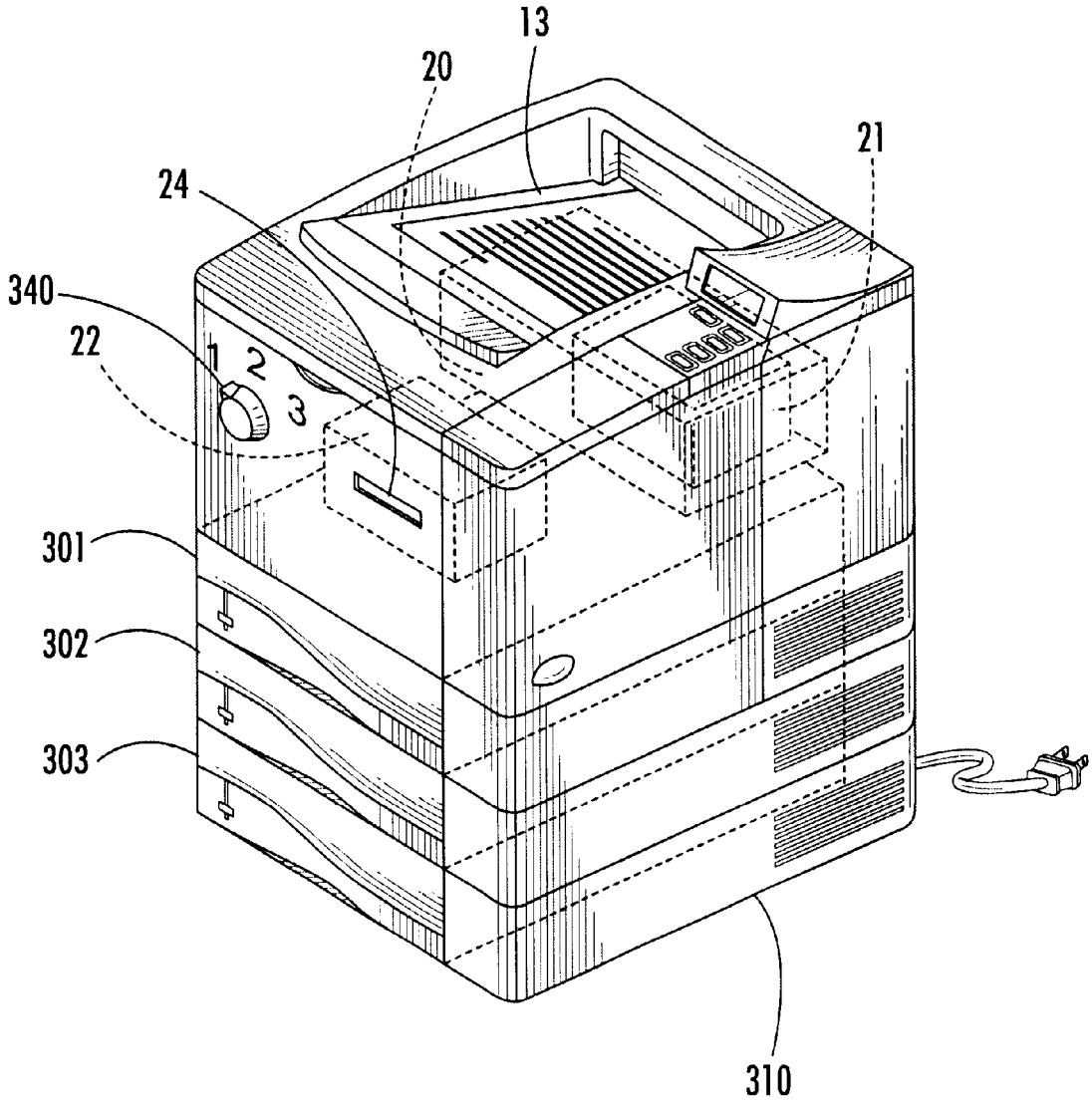
FIG. 3 is a perspective view of a printing apparatus according to an alternative embodiment of the present invention.

FIG. 3 is a perspective view of another printer apparatus 310 according to an alternative embodiment of the present invention. Printer apparatus 310 includes first, second, and third print media trays 301, 302, and 303, respectively, each of which can accommodate print media. In general, each of the trays can accommodate plural sizes of sheets of print media. In the exemplary embodiment, a single record reader, namely reader 22, is provided with printer apparatus 310. A switch connected to a knob 340 can be set to positions designated 1, 2, or 3, to thereby identify tray 301, 302, or 303 as being the one to which the card read by reader 22 pertains. The operator selects the appropriate tray into which print media is to be loaded, and sets the switch 340 to the appropriate setting. When the associated readable record is furnished to record reader 22, the signals which are generated, relating to at least one characteristic of the print media, are transferred to print engine controller 21 for configuring the device by controlling or adjusting as appropriate the various parameters of the print engine 20 when the print media in the selected drawer is accessed by the print engine 20.

Figure 4:
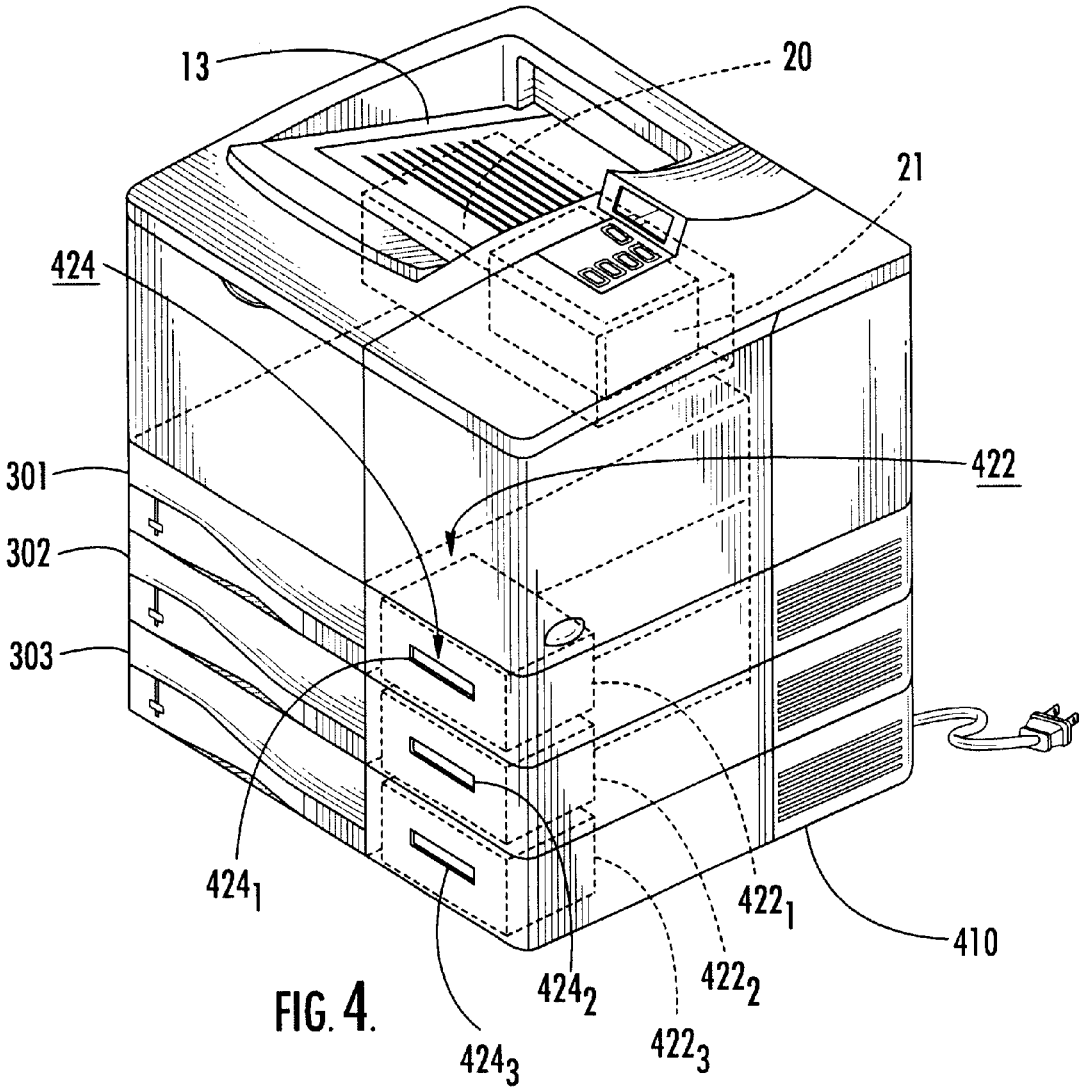
FIG. 4 is a perspective view of a printing apparatus according to another alternative embodiment.

In order to reduce the possibility of operator error in identifying the drawer to which the card is read, the printer apparatus 410 of FIG. 4 can be used. In FIG. 4, printer apparatus 410 includes print engine 20 and its ancillary equipment (not separately illustrated), and also includes first, second, and third trays 301, 302, and 303. Instead of a single record reader with switch as in FIG. 3, printer apparatus 410 includes a set 422 of separate record readers with a corresponding set 424 of holders or slots, one set for each print media tray. More particularly, record reader 4221 and holder 4241 are associated with print media drawer 301. Similarly, record reader 4222 and holder 4242 are associated with print media drawer 302, and record reader 4223 and holder 4243 are associated with print media drawer 303. When a record is read by one of the record readers 4221, 4241; 4222, 4242; 4223, 4243, the signals representing the characteristics of the print media, as recorded on the record, are supplied to print engine controller 21 for control and/or adjustment of the various printer parameters when the print media in that particular tray is accessed. The arrangement of FIG. 4 is less prone to operator error than that of FIG. 3.

Figure 5:
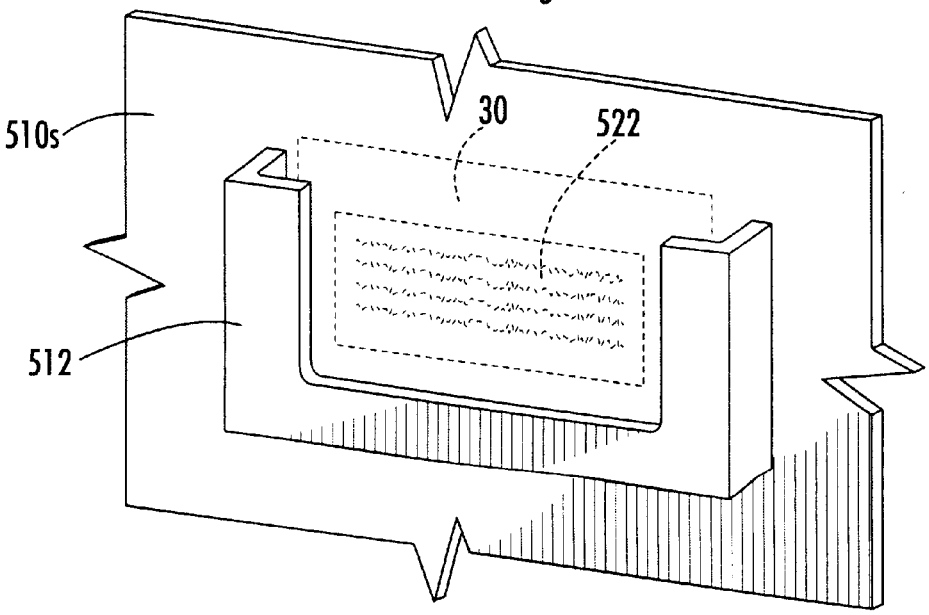
FIG. 5 is a simplified perspective of a portion of an exterior surface of a printing apparatus according to an aspect of the invention, in which a media holder in the form of a card holder holds a machine-readable card with human-readable indicia.

FIG. 5 is a simplified perspective view of a portion of an exterior surface 510*s* of a printer apparatus according to an aspect of the invention, in which a media holder in the form of a card holder 512 holds a machine-readable card, illustrated in phantom view as 30, which also bears human-readable indicia relating to the characteristics of the print media in a region designated 522. That is, the human readable indicia contains at least some of the same characteristics as stored on electronically or optically readable card 30, with the region 522 with human-readable indicia visible to an operator, so that the machine-readable medium does "double duty" by being machine readable by the printer apparatus and also readable by a human operator.

Although the invention has been described and pictured in exemplary form with a certain degree of particularity, it is understood that the present disclosure of such form has been made only by way of example, and that numerous changes in the details of construction and combination and arrangement of parts may be made without departing from the spirit and scope of the invention as hereinafter claimed. For example, while the print engine controller has been described as being physically associated with the print engine, it may be at least partially separate from the print engine. Similarly, the record reader has been described as being associated with the printer apparatus and not with the print engine, but the record reader may be at least partially associated with the print engine, for example. It is intended that the patent shall cover by suitable expression in the appended claims, whatever features of patentable novelty exist in the invention disclosed.

What is claimed is:

1. A printing apparatus for printing on print media, where at least one characteristic of said print media is specified on a machine readable medium which accompanies said print media, but is separable from both said print media and packaging therefor for reading of said readable medium, said printing apparatus comprising:

a reader for reading said readable medium, for generating a signal representing said at least one characteristic of said print media; and a controller responsive to said signal, for configuring said printing apparatus based on said at least one characteristic to form an image on said print media.

2. A printing apparatus according to claim 1, wherein said readable medium comprises a smart card, and said reader further comprises means for producing at least one of an electric field and a magnetic field in the vicinity of said smart card.

3. A printing apparatus according to claim 1, further comprising a holder for holding said readable medium in a particular location for reading by said reader.

4. A printing apparatus according to claim 1, wherein said readable medium is in the form of a card, and said reader comprises an optical reader.

5. A printing apparatus according to claim 4, wherein said characteristic of said print media is specified on an optically readable record in the form of optically contrasting markings.

6. A printing apparatus according to claim 5, wherein said optical reader is fixed to said printing apparatus at a location where it views a location away from a printing media path extending through said printing apparatus.

7. A printing apparatus according to claim 1, wherein said readable medium includes a human-readable portion bearing information relating to at least a characteristic of said print media, and said holder for holding said readable medium is disposed such that, when said readable medium is placed in the holder, the human-readable portion is visible to an operator.

8. A machine readable medium in combination with at least one sheet of print media, the machine readable medium having encoded parameter information that corresponds to the sheet of print media, the machine readable medium adapted to be separable from the print media and packaging therefor such that, during operation, the machine readable medium is physically separate from the print media and packaging, for conveying the encoded parameter information to an imaging device capable of configuring at least one parameter of the imaging device based on the encoded parameter information to form images on the at least one sheet of print media.

9. The combination of claim 8, wherein said machine readable medium comprises an electronically or optically readable card.

10. The combination of claim 9, wherein said electronically or optically readable card includes a human-readable portion bearing information relating to at least one characteristic of said print media.

11. The combination of claim 8, wherein the at least one sheet of print media comprises a plurality of sheets of a given type of print media.

* * * * *